US005759088A

United States Patent [19]

Kondratenko

[11] Patent Number: 5,759,088

[45] Date of Patent: Jun. 2, 1998

[54] PROCESS FOR MACHINING COMPONENTS MADE OF BRITTLE MATERIALS AND A DEVICE FOR CARRYING OUT THE SAME

[76] Inventor: Vladimir Stepanovich Kondratenko, Veshnyakovskaya Str. 12/1-41, Moscow 111402, Russian Federation

[21] Appl. No.: 492,110

[22] PCT Filed: Feb. 12, 1993

[86] PCT No.: PCT/RU93/00042

§ 371 Date: Nov. 22, 1995

§ 102(e) Date: Nov. 22, 1995

[87] PCT Pub. No.: WO94/17956

PCT Pub. Date: Aug. 18, 1994

[51] Int. Cl.[6] ..... B24B 1/00

[52] U.S. Cl. ..... 451/41; 451/269; 451/291

[58] Field of Search ..... 451/41, 287, 288, 451/289, 290, 291, 269

[56] References Cited

U.S. PATENT DOCUMENTS

| | | | |
|---|---|---|---|
| 2,963,830 | 12/1960 | Hook | 451/288 |
| 4,962,616 | 10/1990 | Wittstock | 451/290 |

FOREIGN PATENT DOCUMENTS

| | | | |
|---|---|---|---|
| 56-6102467 | 8/1981 | Japan | 451/288 |
| 228068 | 11/1985 | Japan | 451/288 |
| 62-2264864 | 11/1987 | Japan | 451/288 |
| 1549737 | 3/1990 | U.S.S.R. | 451/287 |

*Primary Examiner*—Robert A. Rose
*Attorney, Agent, or Firm*—Breiner & Breiner

[57] ABSTRACT

The process involves optimizing the load conditions for the machined surfaces of the components, selecting and applying the optimum permissible specific force applied to the tool in the light of the relative thickness of the machined component, and using laser cutting to cut the edges of the components to size after the surface of the components has been machined. The process disclosed is carried out using a novel diamond-abrasive tool and novel devices for the devices concerned.

According to one variant, the device comprises a surface plate (1) with a diamond-abrasive tool and a surface plate (2) arranged eccentrically on which are mounted holders (5) with recesses for the components (4). Each recess has a resilient lining (6). Force is applied by means of a clamping mechanism (7). When surface plates are displaced in relation to each other and the diamond-abrasive layer on the tools is used with a specified configuration and composition of the preforms, and also 20 of the resilient linings whose thickness is calculated using the formula cited, the device in question facilitates the creation of the desired surface and adjustment of the force exerted by the tool on the component.

16 Claims, 5 Drawing Sheets

Figure 1A:
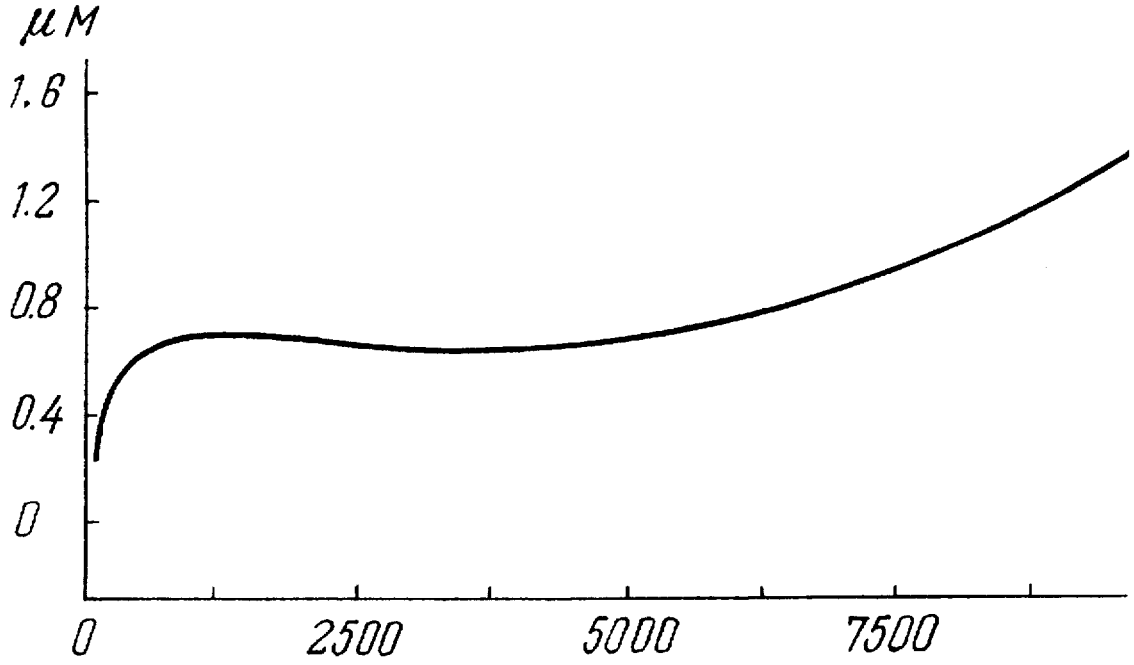

PROCESS FOR MACHINING COMPONENTS MADE OF BRITTLE MATERIALS AND A DEVICE FOR CARRYING OUT THE SAME

FIELD OF THE INVENTION

The invention relates to machining precision components, in particular, to processes of machining components made of brittle materials and devices for carrying out the same.

PRIOR ART

When machining precision components using the method of free lapping there are obtained high accuracies of the form of the surface, whose deviation from the given one may constitute 0.1 to 0.01 of the wavelength. However, producing accurate surfaces is guaranteed for components with a relative thickness (the relationship of thickness and diameter, or the diagonal of a component machined), not affecting the deformation during machining, being $h/D>1/5$. In so doing, productivity of grinding and polishing operations is inversely proportional to the accuracy of the surface obtained.

Yet, in a number of the fields of the present-day engineering there is an extensive range of articles from glass, quartz, ceramics and other materials, for which the above-mentioned restrictions are not applicable. Among them there may be glass and quartz blanks for masks, glass and glass ceramic blanks for magneto-optical and magnetic disks, plates for liquid crystal indicators, screens, to mention a few. The relative thickness of said components is 0.01 and less. At the same time, fairly rigid requirements are set to the working surfaces and geometric dimensions of these articles.

Machining of the above-identified class of articles is effected with the use of a loose abrasive, providing, compared to a coupled diamond tool the reduction of unit loads in the zone of machining. Among the basic drawbacks of such technology are:

- low productivity of labour
- great depth of the layer broken during grinding, the removal of which requires long polishing
- sizable expenditure of abrasive dust due to a low coefficient of their useful utilization;
- low temporary stability of grinding with a loose abrasive;
- low culture of production with bad labour conditions, characterized by a small degree of mechanization and automation of processes owing to the foregoing reasons.

As glass and other brittle materials are ground, the transition from a loose abrasive to a coupled diamond tool spells out a qualitatively novel level of technology, featuring a dramatic growth of machining productivity, high wear-resistance of the tool and better culture of production. However, there are no cases of using the coupled diamond tool for precision finished grinding of thin large-size articles with a relative thickness of $h/D\approx 1/50$ and less with high requirements to the accuracy of the form of the surface to be machined, which may be due to higher specific pressures during diamond grinding.

In addition to high requirements set to the geometry and finish of the working surfaces of the above-mentioned articles, the latter should meet strict requirements as to the accuracy of their overall dimensions. Therefore, the conventional technology of manufacturing articles in question provides for an initial phase of diamond machining and chamfering of the edges of the articles and subsequent machining of their surfaces. The grinding operation is the last one in the technological cycle of machining precision articles. This fact allows for the availability of nonworking/idle zones on the working surface of precision articles, which are arranged along the edges of the components, stipulated by "rounding" of the edges during polishing. For articles, such as magnetic or magneto-optical disks, this shortcoming brings about a dramatic reduction of the effective area of an article and, consequently, a lesser memory of the disk.

Known in the art is a process of machining components, whereby the force is applied on the components, pressing them to the tool and the components and the tool move relative to each other in the plane of machining (USSR Inventor's Certificate No. 1237387). In this process as the forced grinding is performed under loads of 1200 to 4000N there is achieved a higher accuracy of forming a flat surface due to the use of a diamond-abrasive tool with a concave working surface, compensating for deformation of the tool body.

However, these modes of machining are absolutely unacceptable for precise machining of parts with a relative thickness of $h/D<1/10$.

Known in the art is a process of unilateral polishing the components between two tools, in which the components are accommodated in holders in two rows through a lining, the force is applied on the components using an upper tool and relative motion is imparted to the tools and holders (Japanese Application No. 63-93561).

This process can be used to advantage for polishing the surfaces of components already formed during the preceding operations of grinding. It cannot be used to grind components, because the abrasive suspension, having found itself between the linings and components, will cause their deformation. Besides, it is only a rigid lining that can be used in the disclosed design of the holders, which ensures their preservation as the force is applied to components. At the same time, using the rigid linings in grinding thin components is inexpedient, because it leads to deformations.

Thus, the disclosed process of machining components cannot be used to effectively grind thin precision components from glass and other brittle materials with a high elasticity module.

Known in the art is a device for machining components, containing two surface plates, on one of which is secured a tool shaped as a polishing blade to machine components, and on the other there is arranged a resilient lining on which, in turn, a holder with recesses is secured to accommodate the components (USSR Inventors Certificate 958079). The device is also furnished with a clamping mechanism and a rotary drive of one of the surface plates. However, the given device fails to provide high quality machining of thin components. This is due to the fact that the force applied to the press surface plate is distributed evenly on the components machined by means of a resilient lining. And since with an evenly distributed load the material removal is proportional to the linear speed of a relative movement of the component and the tool, it is impossible to obtain a high accuracy of the geometrical shape of the surface using the device in question, because the removals will grow from the centre towards the periphery of the press surface plate. Besides, the resilient lining design being used does not rule out the deformation of thin components machined.

Known in the art is a device for a unilateral polishing of flat surfaces in the components between tools whose working surfaces are formed by polishing blades which contain two coaxially mounted tools, holders with the recesses for components disposed between said tools and mating with the central and external gear wheels, linings to accommodate the components in two rows in the holder recesses and a drive to rotate the tool and the holders (Japanese Application No. 63-93561).

In the given device the components are accommodated in the holder recesses in two rows through the lining and both components are machined simultaneously from one side each using the top and lower tool.

But the described device cannot provide high quality machining of thin large size components with a relative thickness of h/D≈1/50 and less because of an uneven compressibility of the resilient lining as force is applied to the surface being machined. Given the lining is made from an extremely rigid material, then as force is applied to the components, the latter are deformed, making it impossible to obtain a high accuracy of the shape of the surface machined.

Known in the art is a device for machining components, containing a top and lower tools made in the form of coaxially arranged discs with a diamond-abrasive coating, a holder with recesses to accommodate the components and the drive to rotate the tool and the holder (USSR Inventor's Certificate 139204). However, using the above-described annular diamond tools does not permit obtaining the given shape of the surface machined during the machining of thin components from brittle materials due to an irregular loading of the machined original surface with marked deviations of the form from the given one. Attaining of the object set forth becomes more complicated owing to high unit loads, required for the utilization of the compositions of the diamond-abrasive tool.

DISCLOSURE OF THE INVENTION

The present invention is based on the problem of providing a process for machining components made from brittle materials and a device for carrying out the same, with such parameters so that due to a reduction of deformations in machining and of the depth of the broken layer, in addition to a dramatic increase in the labour productivity the quality of machining the surface will be appreciably improved, the number of operations to machine the components' edges using conventional processes will be reduced, as well as the effective area of the working surface of precision components will be increased through eliminating the nonworking zones along the edges of the components.

The problem of the invention is solved by the fact that in the process of machining components made from brittle materials, whereby the components are arranged in holders, loaded by pressing them to a tool, and the components and the tool are moved relative to each other in the plane of machining, according to the invention, as the components' surfaces are machined, the unit load of the tool on the component is found, subject to a relative thickness of the component being machined, from a relationship:

$$Q=(0.7-7)\times10^{-5}\times h/D\times E_0,$$

where

Q is the unit load of the tool on the component machined, MPa;

h/D is a relative thickness of a component machined;

h is the thickness of a component machined, m;

D is the diameter or diagonal of a component machined, m;

$E_0$ is the modulus of elasticity of the material of a component machined, MPa, thus ensuring the deformation of components during machining.

It should be noted that the surface of the components is machined by a diamond-abrasive tool.

The selection of optimal conditions for the force to be applied to the surface being machined, particularly, for components with a relative thickness of the order of 1/50 and less, decreasing their deformation during machining, as well as the established relationship between the permissible unit loads, a relative thickness of the component material, permit observing the condition of accurate formation of the surface machined.

It is expedient, given an additional machining of the components' edges to size, that the cutting to size should be effected by way of preliminary slitting along the line of cutting, heating the cutting line with laser radiation with the density of power $(0.2-20)\times10^6$ W/m$^2$ and with a wavelength, for which the material being cut is opaque, with a relative movement of a laser beam and the material and a local cooling of the heating zone with the aid of a coolant, in so doing, it is very important, first, to machine the surface of a component and, secondly, to machine to size using the above-mentioned method of cutting.

This sequence of operations enables one to reduce some labour-intensive operations of diamond machining of the edges, their bevelling and chamfering, as well as markedly improve the quality of components by ruling out the rounding of the components' edges as the latter are polished.

The disclosed process of machining components will be considered in a greater detail while describing devices carrying out the given process.

In the device for machining components which has two surface plates, on the one of which there is secured a tool to machine the surfaces of components, and the other accommodates a resilient lining on which is fixed a holder with recesses to accommodate the components, a clamping mechanism and a drive to rotate, at least, one of the surface plates, according to the invention, the resilient lining is arranged in each recess of the holder, the thickness of the resilient lining being determined from the following relationship:

$$\frac{0.4Q}{\frac{h}{D}E} \leqq H \leqq \frac{10Q}{\frac{h}{D}E},$$

where

Q is the unit load of the tool on the component machined, MPa;

h/D is a relative thickness of the component machined;

h is the thickness of the component machined, m;

D is the diameter or diagonal of the component machined, m;

E is the modulus of elasticity of the lining material, MPa;

H is the thickness of the resilient lining, m, and the tool is made up of individual diamond-abrasive preforms whose arrangement and composition are such that when machining a component there is obtained a given shape of the machined surface and the regulation of the tool loads on the components machined.

In another device for machining components which contains an upper and lower tools made in the form of disks with a diamond-abrasive coating, between which there are disposed holders with recesses to accommodate components and a drive to rotate the tool and/or holders, according to the invention, in order to apply a diamond-abrasive coating in the form of individual preforms arranged on disks the location and composition of the diamond-abrasive preforms are chosen so that as the components are machined, the preassigned shape of the machined surface is obtained and the tool loads on the machined components are regulated.

The above-mentioned devices make it possible to machine components made from brittle materials under optimal unit loads of the tool on the components in keeping with the above-described process of machining components and provide a high quality machining of the surfaces of components with a relative thickness of $h/D<1/10$.

It is very important that in the device for machining components between two tools, the working surfaces of which are made up of individual abrasive elements, the latter should be arranged on an odd quantity of concentric zones, the amount of abrasive elements covered by one component being chosen from the relationship:

$$n_1 = \frac{(0.4-4)\,10^4 P}{\frac{h}{D}\,S\,K},$$

and the number of abrasive elements both in any zone and in the middle zone should be determined from the respective formulas:

$$n_i=(0.8-1.2)n_1+n_1/4\,(i-1),$$

$$n_{iO}=(1.02-1.2)[(0.8-1.2)n_1+n_1/4\,(i_0-1)],$$

where $n_1$ is the number of abrasive elements covered by one component;

P is total force, N;

h/D is a relative thickness of the machined component, i.e. the relation between the thickness and diameter or the diagonal of the machined component;

S is the area of the working surface of one abrasive element, m;

K is the quantity of simultaneously machined components by each lap;

$n_i$ is the quantity of abrasive elements in the i-th zone;

$n_{iO}$ is the quantity of abrasive elements in the middle zone;

$i_0$ is the ordinal number of the middle zone.

The established law of arrangement of the abrasive elements on laps provides, first, their uniform wearout during operation, second, interrelationship between the permissible specific forces applied on the components of the given thickness with specific pressures on the tool, ensuring the operation of the chosen tool in the conditions of self-sharpening, reduces deformation of the components machined and controls the shape of the surface machined.

Besides, in the device with a unilateral machining of components, arranged in the holder to both sides of the resilient lining, by two tools each lining made composite from, at least, two separate resilient elements connected to each other by means of a jumper, providing uniform application of force upon the flat surfaces of the components during machining.

In a number of cases, it is expedient that the resilient elements and/or jumpers be made discrete or in the form of reservoirs filled with gas or liquid. Besides, the holder proper can be used as the lining jumper, the resilient elements being disposed on the surface of the holder.

The above-mentioned devices provide uniform loading of the machined surfaces of the components, as well as reduction of the deformations thereof in the process of machining. This makes it possible to correct the surface with the original unsatisfactory planeness and cleanliness of the surface during the machining of components with a relative thickness of from 0.1 to 0.001.

It is very important in a number of cases to make the holder silted in the plane of machining and to arrange spring-loaded supports between the holder elements, and to tie up the holder elements per se by guides to move the holder elements in the plane perpendicular to the plane of machining, the rigidity of the spring-loaded supports and resilient elements of the linings being found from the relationship:

$$0.1C_2<C_1<C_2$$

where $C_1$ is rigidity of the spring-loaded supports;

$C_2$ is rigidity of the resilient elements of the linings.

In addition, the resilient elements of the linings are made with decreasing rigidity from the edge towards the center.

This design of the separators makes it possible to effect the conditions of dwelling for the machined surface with minimal unit loads of the order of 0.002 MPa, thus ruling out deformation of the components as the latter are machined, and guaranteeing the provision of minimal broken layer and minimal roughness of the machined surface. This, in turn, reduces 3 to 5 times the time of subsequent polishing of the components.

In a number of cases, it is expedient that the abrasive elements be arranged in a matrix, whose wear resistance is below that of the abrasive elements. Industrial felt, first thermally treated at a temperature from 90° to 140° C. for 0.5 to 5 hours, can serve as the most suitable material of the matrix for grinding and polishing abrasive elements.

This structural solution with the use of the above-identified material improves the microrelief of the surface as the components are polished, and it is a good polishing material with a high wear resistance.

Because the tool is made from individual abrasive elements, the latter consist of the following components in weight percent:

| | |
|---|---|
| epoxy resin | 40–70 |
| hardener | 4.5–9.0 |
| diamond dust | 0.04–8.0 |
| auxiliary abrasive | 10–40 |
| functional additive | 2.2–22.0 |

It is expedient that cerium or zirconium dioxide be used as an auxiliary abrasive, and the mixture (in weight percent) of a water-soluble salt of sulphuric or phosphoric acid (40 to 70 wt. %) and oxalic or citric acid (30 to 60 wt. %)—as a functional additive.

Sometimes, as the abrasive elements are produced, it is expedient that phenoplasts, namely thermoreactive moulding masses based on phenolaldehyde resins, or aminoplasts, namely thermoreactive moulding masses based on carbamido-, melamino and carbamidomelaminoformaldehyde resins, or a mixture of phenoplasts and aminoplasts, be used as a binding agent.

Using the given diamond tool for a coarse or fine grinding reduces, compared to micropowders from electrocorundum with grain size 20 and 10 μm, the depth of the broken layer 4 to 5 times and increases the productivity of grinding 3 to 5 times. A major advantage of the described diamond tool is the possibility of its operation in the conditions of self-sharpening under low specific pressures upon the diamond-bearing layer of the order of 0.005 to 0.05 MPa and at low relative linear velocities of machining in the order of 1 to 3 m/s.

BRIEF LIST OF DRAWINGS

Figure 2:
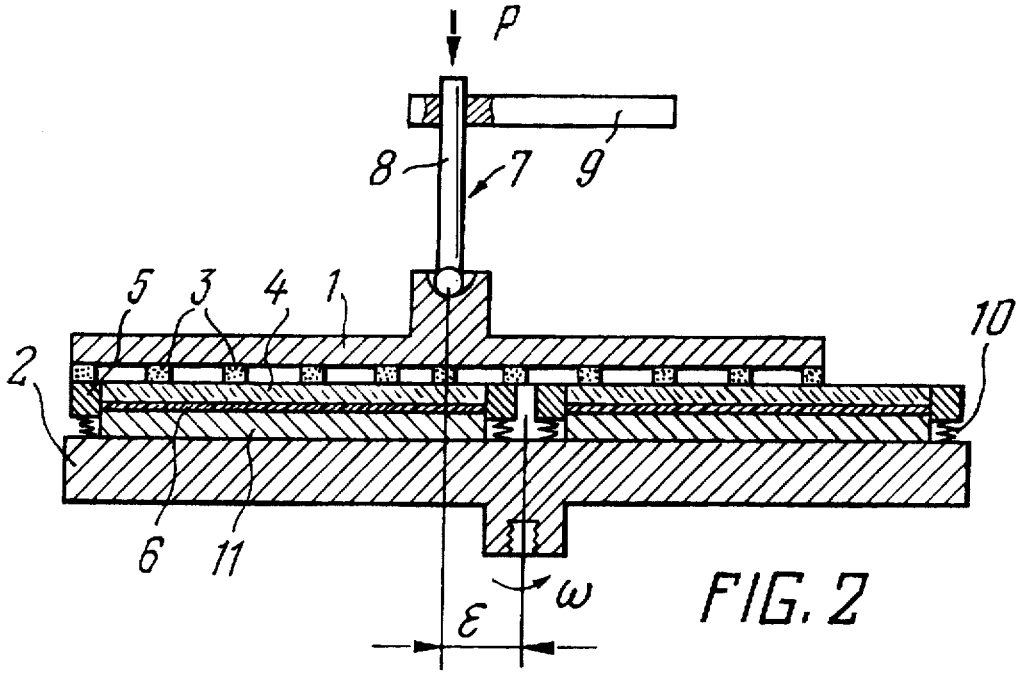
Figure 3:
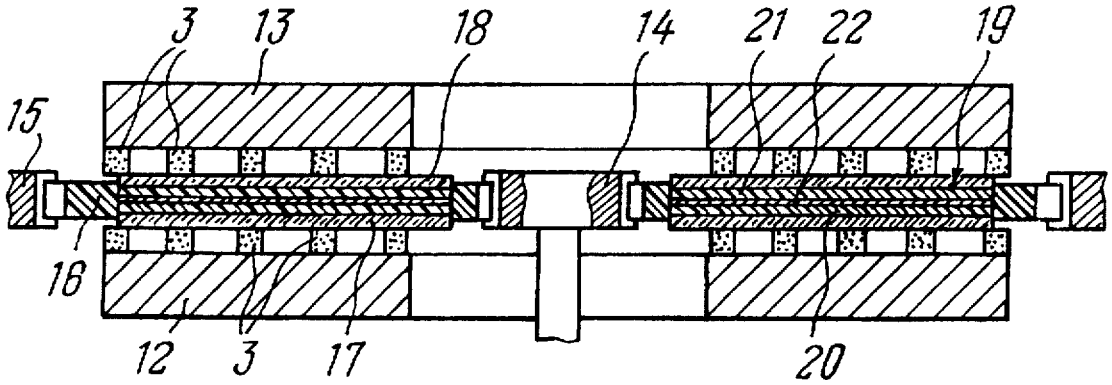
Figure 4:
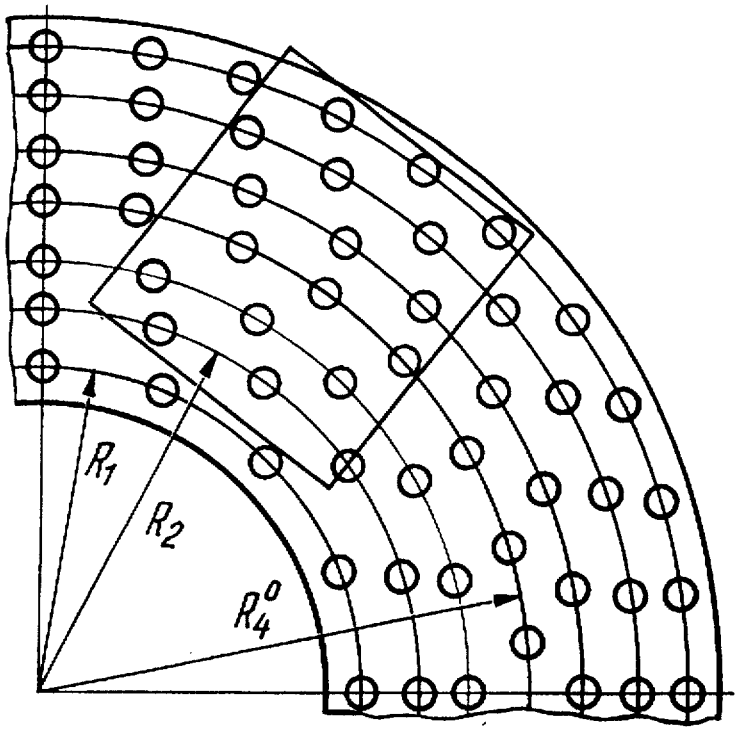
Figure 5A:
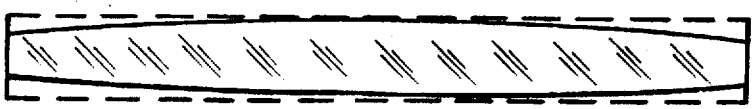
Figure 6:
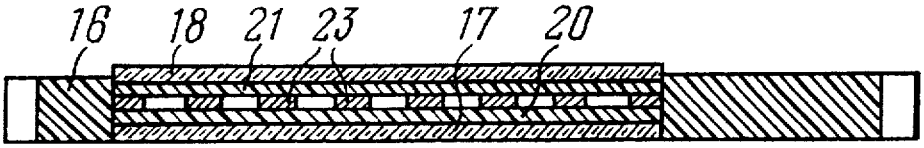
Figure 7:
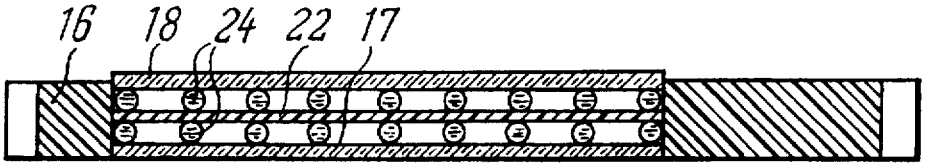
Figure 8:
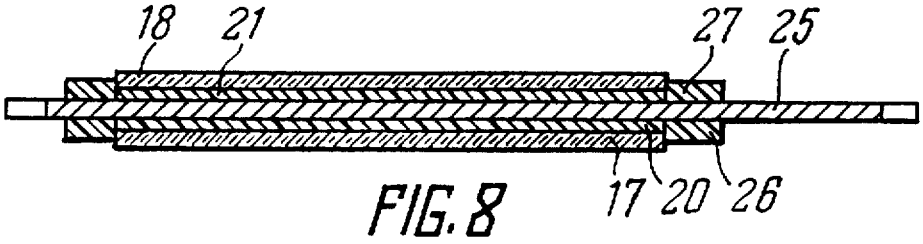

The invention will now be described by way of exemplary embodiments thereof, reference being made to the accompanying drawings, in which:

FIGS. 1*a,b*—shows profilograms of the machined surfaces of glass-ceramic disks, according to the known (a) and disclosed (b) processes;

FIG. 2—shows the diagram of a device for unilateral machining of flat surfaces of the components using one tool;

FIG. 3—shows the diagram of a device for unilateral machining of the surfaces of the components using two coaxial tools;

FIG. 4—shows the diagram of determining the quantity of abrasive elements $n_1$ covered by one component;

FIGS. 5*a,b*—shows the diagram of alteration of the profile of a flat (a) and concave (b) ground surface (broken line) after polishing (continuous line):

FIGS. 6–8—are a cross sectional view of the designs of different variants of holders and resilient linings.

Figure 9:
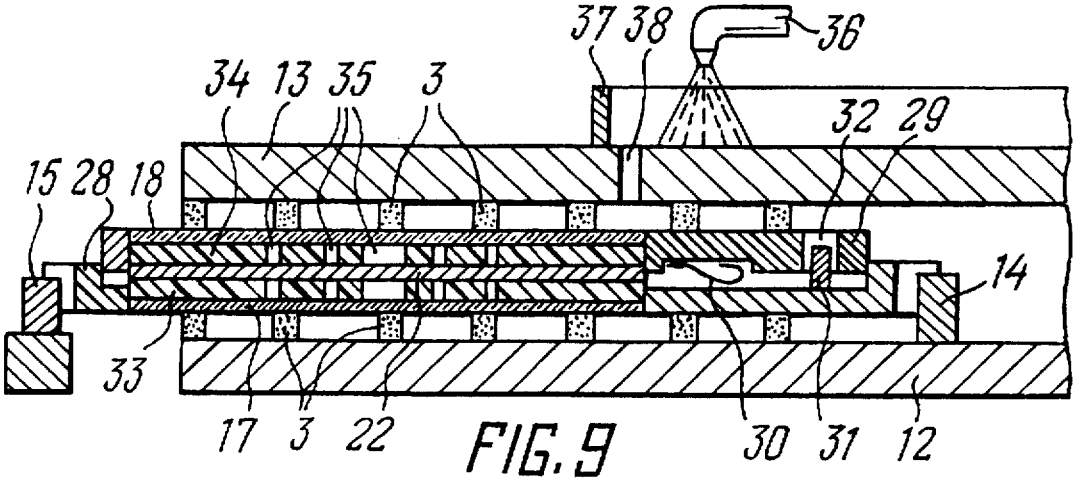
Figure 10A:
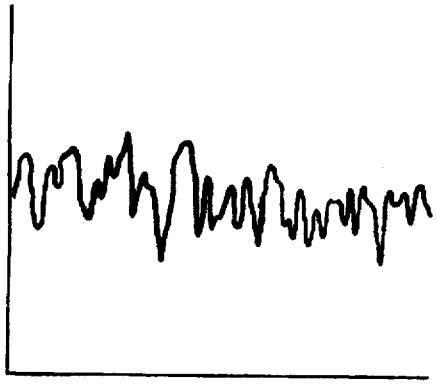
Figure 10B:
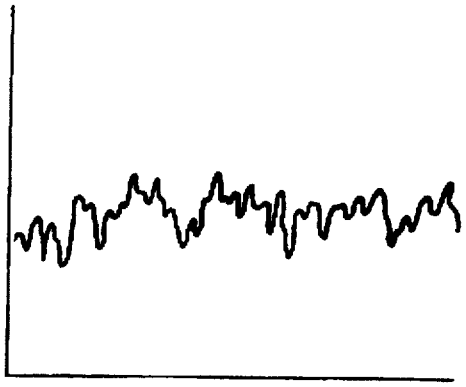
Figure 10C:
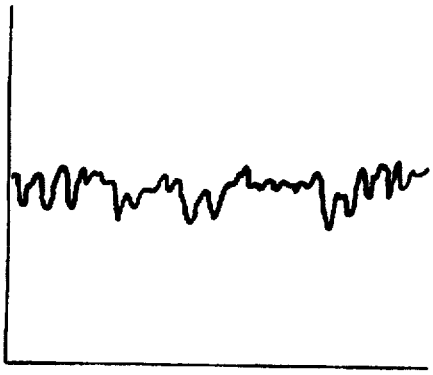
Figure 10D:
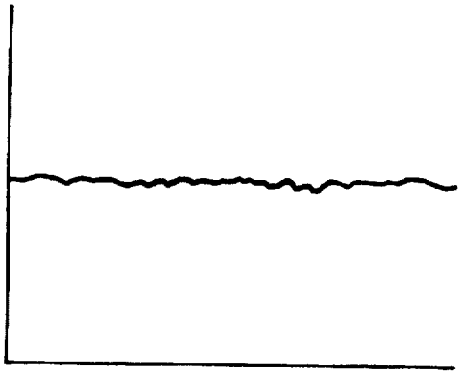

FIG. 9—is the diagram of the device for unilateral machining of components, using two tools with the aid of a composite spring-loaded holder;

FIGS. 10 *a–d*—are the profilograms of the surfaces of glass blanks for masks machined by a loose abrasive, the grain size 20 μm(a) and 10 μm (b), as well as a developed coupled diamond tool after coarse grinding (c) and after fine grinding (d).

BEST MODE FOR CARRYING OUT THE INVENTION

The process for machining components made from brittle materials resides in the fact that the components are placed in holders, loaded, pressed to the tool and the components and the tool are moved relative to each other in the plane of machining, according to the invention, as the surfaces of the components are machined, the unit load of the tool on the component is chosen subject to a relative thickness of the machined component from the relationship:

$$Q=(0.7\text{–}7)\times10^{-5}\times h/D\times E_0,$$

where

Q is the unit load of the tool upon a machined component, MPa;

h/D is a relative thickness of a machined component, h is thickness of a machined component, m;

D is diameter or diagonal of a machined component, m;

$E_0$ is modulus of elasticity of the material of a machined component, MPa.

thus reducing deformation of the components during machining. In so doing, the components' surfaces are machined by a diamond-abrasive tool.

As is known, when machining the flat surfaces of thin components whose relative thickness is h/D<1/5 by a diamond tool, it is impossible to receive a high accuracy of the form of the surface due to deformations of the component during machining. In our case, it is the machining of components with a relative thickness of h/D≈1/50 and less. Given a rigid force is applied on such components, the latter will be deformed. During machining, most projecting parts of the surface will be ground off and the component surface will level off in the tool plane. Yet, upon removing the load, the shape of the machined surface will be changed due to high elasticity of the components' material.

Deformations of the components being machined can be reduced by decreasing the total force applied on the components machined, diminishing unit loads, as well as by redistributing the loads and their averaging across the entire surface being machined.

It has been experimentally established that given a constant unit load, as the relative thickness of the component being loaded is decreased, the value of its deformation grows. Therefore, as components with a given relative thickness are machined, the optimal value of the total unit load on the surface machined is chosen in view of the condition of minimal deformations of the component and the maximum removals of the material. The experiments show that as the relative thickness of the component increases, the value of permissible unit loads can be linearly increased within said range.

In addition, it has been experimentally ascertained that the value of permissible unit loads of the tool on the machined component is linearly dependent on the elasticity modulus of the component material.

In the given range of the tool unit loads on the machined component the minimal values are most acceptable for operations of fine finish grinding and the conditions of dwelling, while the maximum unit loads should be used in preliminary operations of coarse grinding.

The described process of machining components made from brittle materials can be used to machine flat surfaces of the components in which the opposite surface is not flat, e.g. the blanks of flat-convex or flat-concave lenses. In this case, when determining the optimal values of the tool unit loads, an average thickness of the component is chosen as the component thickness for flat-warped blanks and the minimal thickness—for flat-concave blanks. The rest steps of the process remain the same as for flat-parallel components.

In the process of machining components, as described hereinabove, according to the invention, after machining the component surface by way of grinding and/or polishing, the edges of components are additionally machined to size, in so doing, the cutting to size is effected, first by making a slit along the cutting line, heating the latter by laser radiation with a power density of $(0.2\text{–}20)\times10^6$ W/m$^{-2}$ and a wavelength for which the material being cut is opaque, with a relative movement of laser radiation and the material and a local cooling of the heating zone using a coolant. It is important that first the component surface is machined and, then, machining to size is effected using the described process.

As is known, not only the working surfaces, but also the overall dimensions of precision components, such as blanks for masks, blanks for magnet and magnet-optical disks should meet very stringent requirements. Therefore, the operation of machining the component edges to size using a diamond-abrasive tool serves as a separate operation in the process of manufacturing the components in question. Since such machining of the edges may involve damaging of the component working surface, it is the edges that are machined first and then the surface, the last operation being the polishing of the component surface. This sequence of operations fails to provide a high quality of the working surface, because as the components are polished, the edges are "rounded" to reduce the efficient working area of the component.

One can avoid the above-mentioned disadvantages in the manufacture of precision components, if the surface of the original blank is initially machined, as well as polished, and then the edge is machined to size using laser cutting, ruling out the damage of the working surface and providing requisite accuracy of geometrical dimensions.

This process of cutting nonmetal materials under the effect of thermoresilient stresses, arising as a result of local cooling of the section of the material preheated by laser radiation, consists in forming a nonthrough separating crack in the material, the depth, shape and direction of the extension of which can be regulated over a wide range.

The cutting line is heated by laser radiation up to a temperature that does not exceed the one of softening of the material and the velocity of a relative movement of the laser beam and the material, and the place of local cooling of the heating zone are chosen from the condition of forming a nonthrough separating crack in the material.

Using the elliptic section laser beam to heat the material surface along the cutting line helps increase productivity and quality of cutting. In cutting along the curvilinear contour, it is necessary that the laser elliptic beam should be orientated, during cutting, along the tangent to the cutting line at any point of the curvilinear contour.

In order to control the shape and the direction of the development of a separating crack the heating should be carried out by means of a laser beam with the redistribution of energy relative to the trajectory of movement and the position of the cooling zone on the surface of the material should be adjusted with respect to the position of the beam.

In a number of cases, it is desirable, upon obtaining a nonthrough separating crack in the material, that a repeat heating of the cutting line be effected. The second heating of the cutting line appreciably increases the depth of the separating crack or provides a through piercing.

The process of cutting nonmetal materials resides in the following.

As the surface of nonmetal materials, e.g. glass is heated by laser radiation, appreciable compressive stresses arise in the external layers of the material which, however, do not result in failures or destruction. There are the following obligatory conditions of heating during cutting. First, the laser beam should provide surface heating, i.e. radiation should have a wavelength for which the material is opaque. For instance, for glass this is the radiation of an infrared band with a wavelength of over 2 μm, which can be provided by a $CO_2$-laser radiation with a 10.6 μm wavelength, CO-laser with a wavelength of the order of 5.5 μm, or a HF-laser radiation with a 2.9 μm wavelength. Secondly, as the material surface is heated, the maximum temperature of heating should not exceed the temperature of softening of the material. Otherwise, once the material exceeds the plastic limit after cooling, residual thermal stresses occur in the material along the cutting line, resulting in cracks.

As the coolant is fed following the laser beam, the material surface is drastically cooled locally along the cutting line. The gradient of temperature formed stipulates the emergence of tensile stresses in the surface layers of the material. If these stresses surpass the material ultimate strength, a nonthrough separating crack is developed in the material, penetrating deep in the material up to the internal layers experiencing compressive stress.

Among the factors of paramount importance for the process of cutting by way of obtaining a nonthrough separating crack under the effect of thermoresilient stresses are:

parameters of a laser beam, namely the radiation power density, dimensions and shape of the beam on the surface of a material being separated;

relative velocity of the beam and the material;

thermal properties, quantity and conditions of the feed of the coolant to the heating zone;

thermo-physical and mechanical properties of the material being separated, its thickness and the condition of the surface.

To optimize the cutting conditions for different materials, it is necessary to establish interrelationship between the major parameters of the process.

When determining the maximum power density of laser radiation for any material being cut, one should bear in mind that the maximum temperature of heating should not exceed that of softening of the material. Therefore, the minimal power density of $0.2\times10^6$ W/m$^2$ is applicable for most low-melting brands of glass of a great thickness and minimal velocities of thermal cleavage. The maximum density of power $20\times10^6$ W/m$^2$ may be used in cutting high-melting quartz glass, corundum and other materials with a high temperature of softening and/or high value of the temperature conductivity coefficient.

It has been established that the velocity of thermal cleavage is in inverse proportion to the depth of a separating crack. As thin sheet materials from 0.3 to 2 mm in thickness are cut even at high velocities of 100 to 500 mm/s, the depth of a developing microcrack is sufficient for subsequent cleavage according to the established contour. However, as thicker materials are cut even at low velocities, an insufficiently deep crack is developed that could provide, eventually, a quality separation of the material.

It has been experimentally established that a preheating of the material being cut up to a temperature in a range of $(0.4–1)\Delta T$, where $\Delta T$ is thermal stability of the material upon cooling, brings about a drastic rise of the rate of thermal cleavage and a deeper separating crack.

It was pointed out that in a number of cases it is necessary to perform a repeat heating of the cutting line with the aim of deepening the nonthrough separating crack or final through piercing of the material according to the assigned contour. This is associated with the fact that the foregoing steps lead to the formation of a nonthrough and in some cases fairly not deep microcrack. Given rectilinear cutting, the material is ultimately separated into parts by way of fracturing the undercut material manually, or with the aid of special mechanisms or means. However, it is difficult to fracture a blank with a closed curvilinear contour. To solve this problem one should carry out a repeat heating of the cutting line with a laser beam or using other source of heat. Thermal stresses resulting from the repeat heating cause further deepening of the separating nonthrough crack. The value of crack deepening is contingent on the power of a heat source, the velocity of cutting, thickness of material and the depth of an initial microcrack. Varying the parameters in question, one can obtain a different deepening of the crack, right up to a through piercing.

It was indicated that given cutting along the curvilinear contour, the elliptic section laser beam should be strictly orientated along the tangent to the line of cutting in any point of the curvilinear contour. On the one hand, this is due to a marked dependence of the velocity of thermal cleavage on the angle of rotation of the elliptic beam relative to the direction of movement. On the other hand, the necessity of the beam orientation along the line tangent to that of cutting, particularly during a repeat heating, is associated with the need to obtain a component edge perpendicular to the surface of the component material. If the elliptic beam deviates from the tangent, an asymmetric distribution of thermal stresses occurs in the material, resulting in the deviation of the angle of the crack plane from the normal angle relative to the surface which in a number of cases is impermissible.

The process is carried out as follows. A component blank is taken, whose surface has been ground and polished. It is placed on a coordinate table. The table is turned on according to the given program together with a cut application mechanism which is a little diamond pyramid or a pin being pressed with an adjusted force to the surface of the blank at a definite time for a very short period of time. Laser radiation is directed from the laser through the focal lens to the blank surface in the place with a slit. The injector is turned on to feed air-water mixture (coolant) to the heating zone at the moment when the injector is located above the place with the slit. A microcrack is developed in the place where the coolant is fed to, which extends along the cutting line as the blank moves. As soon as the cutting line, specified by the microcrack, is closed to form a closed contour, the coolant ceases to be fed to the heating zone. However, the movement of a blank and heating of the cutting line by laser radiation continue for one more complete cycle. Once the through separating crack is formed, laser radiation is cut off along the entire closed contour, the coordinate table is stopped and the blank is taken out. Upon trimming of the flash, a finished product is obtained, in the example described it is a precision glass disk.

Using the described process of machining components in the cited sequence of operations provides the following advantages over the prior art processes of machining:

- a decline in labour intensity during machining of edges to size;
- ruling out of a number of operations, in particular, chamfering;
- upgrading the machining of surface by dispensing with "roundings" along the component edge and, consequently, an increase in the effective working area of the components.

Figure 1B:
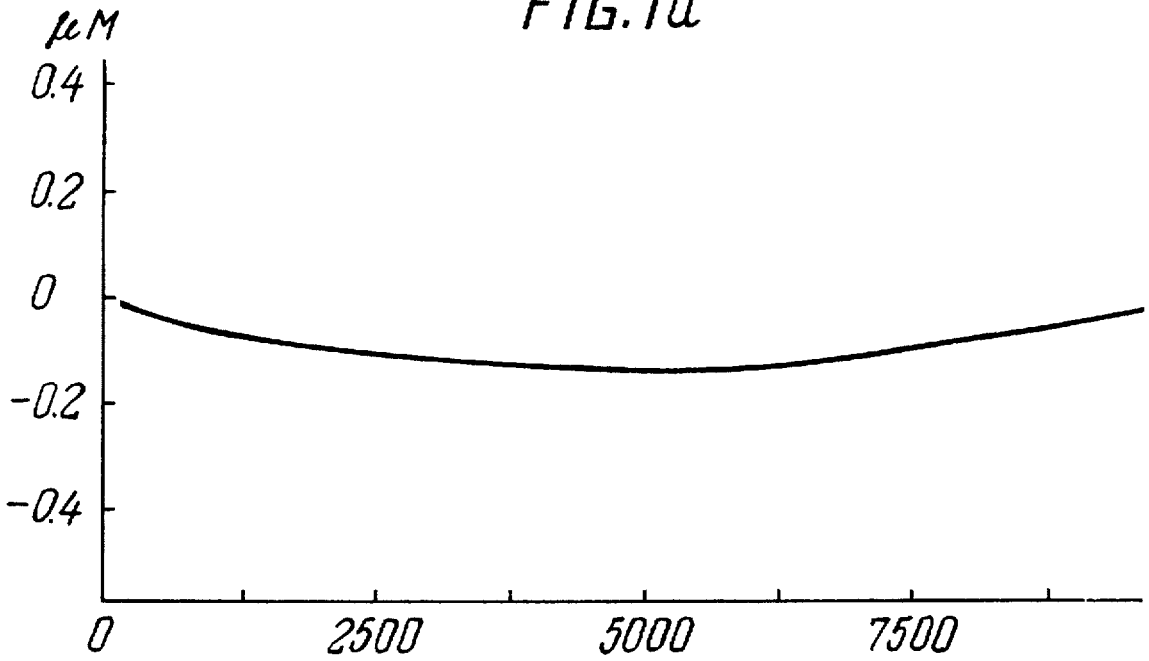

FIGS. 1(*a,b*) shows, for the sake of comparison, the profiles of the machined surfaces of disks made of glass ceramic of 6.5 mm in diameter and 0.635 mm in thickness, using the conventional technology (a), whereby the surface polishing is the last operation and, according to the invention to be claimed (b), whereby cutting of blanks to size is the last operation. The given profilograms show that the accuracy of surface machining according to the process of the invention is 15 times higher than the prior art technology can provide.

A number of variants of the device can be realized to accomplish the above process of machining components. Subject to requirements set in each specific case to a machined component, first it is one surface thereof that can be machined, or both, second, machining can consist only in grinding of the surface, or polishing, or grinding and subsequent polishing, and in a number of cases, it is necessary to additionally machine the component edges to size. In each particular case under consideration, an optimal device should be used.

A simplest device for machining components is the device (FIG. 2) for unilateral machining of components, containing two surface plates 1 and 2, on the one of which, namely, on surface plate 1 is secured a tool 3 to machine the surfaces of components 4, which is made in the form of separate diamond-abrasive preforms. Mounted on the other surface plate 2 are holders 5 with recesses to accommodate the components 4, a resilient lining 6 being arranged in each recess of the holder 5. Force is applied to the machined components 4 by means of a clamping mechanism 7 made as a support 8, one end of which is fixed in the surface plate 1, and the other is secured in a carrier 9 to transmit the load to the surface plate 1 and to effect, if necessary, a reciprocating motion of the clamping mechanism 7. Between the holder 5 and the lower surface plate 5 provision is made for spring-loaded supports 10, and a bearing platform 11, made to the size of the machined component 4, serves as guides to move the holder 5 in a vertical plane.

It should be noted that given more stringent conditions of machining, the holder 5 can be secured directly on the lower drive surface plate 2 without spring-loaded supports 10.

The device operates as follows.

Blanks of the component 4 are placed on the resilient linings 6 in the recess of the holder 5. Thereafter, a clamping upper surface plate 1 with a tool is installed, the carrier 9 with a pivoting support 8 is lowered and the lower surface plate 2 rotation drive and the mechanism for applying force P on the carrier 7 are turned on. Due to the difference of friction forces arising between the contacting surfaces of the rotating tool formed by the abrasive elements 3 and component 4, a pressure surface plate is rotated which is arranged with eccentricity e relative to the drive surface plate 2. The force applied on the pressure upper surface plate is distributed to the components 4 machined by means of resilient linings 6. The resilient lining arranged in each recess of the holder 5 is made of a resilient material. Thickness of the resilient lining is found from the following relationship:

$$\frac{0.4\,Q}{\frac{h}{D}\,E} \leqq H \leqq \frac{10\,Q}{\frac{h}{D}\,E},$$

where

Q is the tool unit load on a machined component, MPa;

h/D is a relative thickness of a machined component;

h is thickness of a machined component, m;

D is diameter or diagonal of a machined component, m;

E is the elasticity modulus of the lining material, MPa;

H is thickness of the resilient lining, m.

A more universal for machining flat surfaces of components is a device (FIG. 3) comprising two tools made in the form of a lower disk 12 and an upper disk 13, coaxial with the latter, on the surfaces of which are secured diamond-abrasive coatings 3. Arranged between the disks 12 and 13 and mating with the central and external gears 14 and 15 are holders 16 with recesses to accommodate machined components. In so doing, the diamond-abrasive coatings are made in the form of separate preforms, and the diamond-abrasive preforms have such a composition and are arranged so that as the components are machined, a preassigned shape of the surface machined is obtained and the tool loads on the machined components are regulated.

When machining components between two tools whose working surfaces are made up of separate abrasive elements, the latter are placed on an odd quantity of concentric zones, the number of the abrasive elements covered by one component is chosen from the relationship:

$$n_1 = \frac{(0.4-4)\,10^4\,P}{\frac{h}{D}\,S\,K},$$

and the number of the abrasive elements in any zone and in the middle zone is determined from the respective formulae:

$$n_i = (0.8-1.2)n_1 + n_1/4\,(i-1),$$

$$n_{i0}=(1.02-1.2)[(0.8-1.2)n_1+n_1/4\ (i_0-1)],$$

where $n_1$ is the number of abrasive elements covered by one component;

P is the total load/force N h/D is a relative thickness of a machined component, i.e. the relation of the thickness to diameter or diagonal of the machined component;

S is the area of the working surface of one abrasive element, m;

K is the quantity of components simultaneously machined by each lap;

$n_i$ is the quantity of abrasive elements in the i-th zone;

$n_{i0}$ is the quantity of abrasive elements in the middle zone;

$i_0$ is the ordinal number of the middle zone.

Making the tool, whose working surface is made up of separate abrasive elements allows, given the constant unit load, the total load to be decreased many times.

Altering the density of filling of the abrasive elements in the zone of machining, i.e. the quantity of elements covered with one component (FIG. 4) permits attaining the requisite unit loads in the cutting zone. The maximum unit load should be determined with due regard for a relative thickness of the machined component. The smaller the latter, the lesser should be the unit load in the zone of machining. For instance, given a coarse grinding of glass plates with a relative thickness of h/D=1/10 the optimal unit load is close to 0.2 MPa, in case of grinding the components with a relative thickness of 1/100, the load should be decreased to 0.01–0.02 MPa. From the above reasoning the density of filling the working surface of the tool with abrasive elements is determined.

In addition to providing requisite unit loads in the zone of machining, the arrangement of the abrasive elements on the surface of the laps should help form a desired geometry of the machined surface. When machining the flat surfaces of components through grinding, one strives to obtain a flat surface with minimal deviations as to planeness.

Figure 5B:
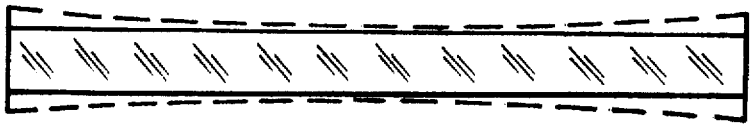

In case it is necessary to obtain a polished surface with minimal deviations of the surface from a flat shape, the following difficulties come into being. It is known that given a prolonged polishing of the surface, especially using non-rigid felt or cloth polishing materials, there occurs a more intensive removal of material at the components' edges, with the result that a convex surface is obtained (FIG. 5*a*) after polishing of the flat originally ground surface. If a plate with a concave surface (FIG. 5*b*) is to be obtained during grinding, then upon polishing and due to "rounding" of the edges the planeness is improved to reach minimal deviations from a flat ideal surface. FIGS. 5(*a,b*) shows the surface profile after grinding (broken line) and the profile of the eventually machined surface after polishing (continuous line).

Thus, in order to obtain the components with high requirements as to planeness, a preassigned concave surface should be obtained during grinding. In so doing, the value of the preset concave camber will be defined by the following factors: dimensions of the machined components and the time of polishing thereof which is essentially subject to the depth of the layer broken during the last finish grinding. For example, it is established that in producing mask blanks 102×102×2.6 mm in size the optimal concave camber, following grinding, was 2 μm, and for blanks 127×127 mm in size 3 μm. The maximum depth of the broken layer after grinding does not exceed 6 μm.

For this purpose, the density of filling in the middle row is set 1.02 to 1.2 times higher compared to any row. The value 1.02 is chosen from the considerations that a 2% increase in the density of filling the middle row provides a stable alteration of planeness to the side of the concave surface to a very insignificant value (less than 1 μm). Given a less value of the correction factor, it is impossible to obtain a stable deviation of planeness to the side of the concave surface. The maximum value of 1.2 is stipulated by the fact that given greater quantities thereof, the deviation of planeness is significant to such an extent that even during prolonged polishing it is impossible to obtain a flat surface, and a number of centers are developed on the polished surface.

In addition to necessary unit loads and a preassigned shape of the machined surface, the principle of the arrangement of abrasive elements proposed in this invention provides for a uniform wearout of the tool in operation. This virtually rules out periodic setting of the tool which is characteristic of laps operating with a loose abrasive.

Thus, using the tool made up of separate abrasive elements, arranged according to the proposed principle on the surface of the laps, helps to drastically decrease the unit loads in the zone of machining.

Optimizing the conditions of force application on the machined component is a major step to upgrade the machining of the surfaces of components with a relative thickness of h/D<1/10. As is known, given a rigid loading of the machined component between two laps, a relative thickness of the component should be at least 1/5. Otherwise, deformations in the component will not permit obtaining an accurate shape of the surface machined.

It was found that the quality of machining thin components is subject to not only the original planeness of the tool working surface, but also to the form of an external load. If the form of the latter and the surface of the component contacting it fail to coincide, then the zones of local stresses emerge during machining, which cause deformation of the component.

Experiments show that if force is applied to the components with the aid of a resilient lining disposed between the two components, this enables one to decrease 5 to 7 times the effect of unit loads on the value of deformations in the components with the same relative thickness compared to rigid loading.

The point is that as force is applied to the component with the aid of a resilient lining made of the material with a definite thickness and elasticity modulus, the given resilient element fully copies the shape of a contacting surface, which is most important at the initial phase of machining when the projecting sections of the machined component are ground off. Excess pressure on these sections will be redistributed according to the Pascal' law in all directions, i.e. across the entire surface.

In the device (FIG. 3), given unilateral machining of components 17 and 18, arranged in the holder 16 to both sides of the resilient lining 19, using two tools, each lining should be made composite, at least, of two separate resilient elements 20 and 21, connected to each other by means of a jumper 22, thus applying uniform force to the flat surfaces of the components during machining.

There may be different variants of producing holders and resilient linings, providing uniform loading of the flat surfaces of the components during machining.

In particular, FIG. 6 shows the holder 16 with a lining consisting of the lower and upper resilient elements 19 and 20, and a discrete jumper 23, which connects the resilient elements 19 and 20 to a single three-layer lining. It is also possible to use discrete resilient elements with a continuous jumper.

FIG. 7 illustrates the holder 16 with a lining, in which the lower and upper resilient elements are made in the form of separate insulated tanks 24 filled with gas or liquid, connected with the aid of a jumper 21 to form a single lining.

Shown in FIG. 8 is a holder 25 with a resilient lining, in which the holder per se is used as a jumper, the resilient elements 20 and 21 being disposed immediately on the surface of this holder. The recesses to accommodate the components 17 and 18 are formed by means of superposed elements 26 and 27.

Using the composite resilient lining is appropriate for the following reasons. If a single-layer resilient element is used as a lining, then as thin large-size components with a relative thickness of $h/D \approx 1/50$ and less are machined, they are unevenly loaded due to a nonuniform compressibility of the lining. The force in this case will decline from the center towards periphery. The less the relative thickness of machined components, the less should be resilience of the lining used. However, the less uniform will in this case be the distribution of load across the surface of the component.

This contradiction can be eliminated by using a combination lining, consisting of two resilient elements linked to each other by means of a jumper made of a more rigid material. Besides, in order to obtain a more uniform redistribution of loads across the entire machined surface, the resilient elements or the jumper therebetween are made discrete, i.e. consisting of individual elements arranged in a "staggered" pattern.

A tank filled with gas or liquid can be used as resilient elements. In this case, the tank should be made of a sufficiently elastic material with a small thickness to provide complete copying of the component contacting surface. From the standpoint of uniform redistribution of a static load this lining is ideal. Yet, in the process of machining the liquid in the tank during rotation is redistributed under the effect of a centrifugal force and fails to provide a high quality machining.

This disadvantage is eliminated as follows. The resilient elements are made in the form of individual insulated tanks of a small volume filled with liquid or gas. The given tanks are evenly distributed across the entire area of the lining and are fixed with the aid of a jumper. This lining ensures uniform redistribution of loads across the entire surface machined, ideally copies the contacting surface of the component and, consequently, provides a high quality machining.

In the operations of finish fine grinding, the main designation of which is to prepare the surface for polishing, i.e. to form the surface with minimal roughness and the least broken layer, it is necessary that machining be effected under minimal unit loads. In this case, the cited designs of the holders made up of a monolithic body and a resilient lining cannot guarantee the preservation of components as the latter are loaded and machined. The point is that an unloaded upper resilient element projects above the surface of the holder. The top machined component is arranged on an resilient lining opposite the recess of a separator. As the component is loaded by the top tool, the component may displace relative to the recess, thus damaging or breaking the component may occur.

In this case, it is expedient the holder be made as a slit one in the plane of machining, supports 30 being accommodated between the elements of the holder 28 and 29. The holder composite elements per se are interlinked by guides, providing the movement of the holder elements in the plane perpendicular to that of machining. The rigidity of the spring-loaded supports and the resilient elements of linings is interrelated by the relationship:

$$0.1\ C_2 < C_1 < C_2,$$

where $C_1$ is rigidity of the spring-loaded supports;

$C_2$ is rigidity of the resilient elements of linings.

FIG. 9 illustrates a diagram of the device to machine components using the described holders.

The device has a lower and upper bases 12 and 13 on which the abrasive elements 3 are secured. Mating with the central and external gears 14 and 15 is a holder consisting of two composite elements 28 and 29 with spring-loaded supports 30 arranged therebetween. Besides, in the lower element of the holder 28 there is a pin 31 and in the upper element there is an opening 32 which serve as guides ensuring the movement of the holder elements 28 and 29 relative to each other vertically. The holder recess, made coaxially in the element 28 and 29, accommodates components 17 and 18 with a resilient lining arranged therebetween which consists of resilient elements 33 and 34 and a jumper 22.

In the given device, the rigidity of the resilient elements of the linings declines from the edge towards the center due to the fact that discharge openings 35 are provided in the resilient elements 33 and 34. Thus, force is uniformly applied to the machined components due to uniform compression of the resilient elements as force is applied to the cited elements and the components are machined. The diameter and density of the arrangement of the discharge openings 35 are selected subject to a relative thickness of the machined components h/D, as well as modulus of elasticity and thickness of the resilient elements 33 and 34.

The height and rigidity of unloaded spring-loaded supports 30 should provide a total height of the composite holder exceeding the total height of the lower component 17 and the unloaded resilient lining. The fulfilment of this condition provides simple loading of the upper component 18 to the recess of the upper element 29 of the holder and rules out possible breakdown of the component 18 as force is applied from the top tool and the startup of the machine drive.

Besides, in the top part of the device provision is made for a conduit 36 to feed a lubricant-coolant to an annular tank 37 communicating via ducts 38 with the component machining zone.

The above-mentioned condition should be observed, namely the rigidity of the spring-loaded supports $C_1$ must be less than that of the resilient elements $C_2$ of the lining.

In this case, a greater part of the force is applied to the machined components 17 and 18, and the lesser part—to the composite elements 28 and 29 of the holder. At the same time as the holder spring-loaded element 29 is pressed to the top tool by means of spring-loaded supports 30, it holds the thin component 18 in the holder recess during machining.

Even in the conditions of components' dwelling in the process of finish grinding, when unit loads on the machined components are minimal, given the indicated relation of $C_1$ and $C_2$ rigidity, the spring-loaded part of the holder 29 holds the component 18 in the recess.

If the rigidity of the resilient supports and resilient elements is the same, i.e. given $C_1/C_2=1$, it is impossible to dwell the components, and the wearout of holders will be very high. Still, if $C_1/C_2<0.1$, the force of pressing the spring-loaded part of the holder 29 to the top tool may be insufficient, which may result in the component breakdown during machining.

In a number of cases related to the specifics of machined components and the tools and fittings used, it is impossible to use the tools in the form of individual abrasive elements arranged on the surface of the base. In this case, it is expedient the abrasive elements be arranged in a matrix, whose wear resistance is lower than the wear resistance of abrasive elements. The matrix, with the abrasive elements placed therein, should be secured on the base of the tool.

It has been found that in order to achieve the objective of the invention it is expedient that industrial felt of chemical fibers, preheated at 90° to 140° C. for 0.5 to 5 hours, should be used as the matrix material. The industrial felt of chemical fibers, being a loose readily carded fabric, is intended for the filtration of gases and diesel fuel and for sound insulation. Following thermal treatment under the cited conditions, the material is shrunk and condensed. The duration of thermal treatment is in inverse proportion to the temperature of thermal treatment. At the same time, the period of thermal treatment grows linearly within the cited range, as the felt fabric used becomes thicker.

Experimental studies show that the conditions of thermal treatment are optimal when the felt elasticity modulus, after treatment, is in the range of 2 to 4 gPa.

It is most expedient that the tool of such a design, namely where the abrasive elements are arranged in a matrix, should be used in two-sided machining of components using the above-described device, but dispensing with a resilient lining. This is most important in producing components with higher requirements set to different thicknesses. Therefore, it is desirable that primary machining be effected using operations of two-sided grinding with the aid of the tool in question, where different thicknesses and lack of parallelism in the original blank will be eliminated. It is expedient that fine grinding be performed by way of unilateral grinding with the use of resilient linings and spring-loaded composite holders. In a number of cases, polishing should be effected by way of two-sided machining without resilient linings.

When defining optimal unit loads, in addition to their effect on the accuracy of machining the surface, there is another important criterion, namely observing the conditions ensuring effective operation, i.e. operation in the conditions of self-sharpening of the coupled abrasive tool.

The prior art types of the coupled diamond tool are designed to operate under high unit pressures of 0.03 to 0.15 MPa and at high relative linear velocities of 10 to 40 m/s (see V. V. Rogov, "Finish Diamond-Abrasive Machining of Nonmetal Components"—Kiev, Naukova dumka Publishers, 1985, page 264). Yet, these conditions are not acceptable for machining components with a relative thickness of the order of 1/50 and less, because they cause marked deformations of components during machining.

In view of the foregoing, it is necessary to develop a coupled abrasive tool, operating under low specific pressures within 0.005 to 0.05 MPa and at low relative linear velocities of the tool and the machined component of the order of 1 to 3 m/s.

The diamond tool on an organic binder meets the foregoing conditions. An epoxy-dian (4,4-isopropylidenediphenol) resin with polyethylene polyamine as a hardener was chosen as a binding agent. Aside of epoxy dian resin and polyethylene polyamine, the given diamond tool contains diamond dust, auxiliary abrasive and a functional additive. Used as an auxiliary abrasive is cerium or zirconium dioxide and the mixture of water-soluble salt of sulfuric or phosphoric acid and oxalic or citric acid is used as a functional additive. The components of the material are taken in the following relationship (in wt. %):

| | |
|---|---|
| epoxy resin | 40–70 |
| polyethylene polyamine | 4.5–9.0 |
| diamond dust | 0.04–8.0 |
| auxiliary abrasive | 10–40 |
| functional additive | 2.2–22.0 |

Using cerium or zirconium dioxides as an auxiliary abrasive, which have a relatively low strength and fine dispersed scaly or lamellar structure, helps improve resilient-plastic properties of the tool and reduce its greasing during operation. Besides, the auxiliary abrasive (cerium or zirconium dioxide) aids in eliminating microirregularities on the machined surface, i.e. takes part in forming microrelief. The complex of cerium (zirconium) dioxide, i.e. diamond grains in the cited relationships, makes up the frame of an abrasive mass with a highly developed surface having a high reaction capacity. At the same time, the frame lacks loose conglomerates which in the process of grinding would separate individual uncoupled diamond grains.

The functional additive, consisting of the mixture of the water-soluble salt of sulphuric or phosphoric and oxalic or citric acid, performs a dual function. First, this is a tribochemical effect of reagents on the surface of glass or glass-like material in the zone of contact of the tool with the machined component and, second, loosening of the binding agent and renewal of new diamond layers due to the dissolution of fine-dispersed particles of the cited chemical reagents under the effect of water, being the basic ingredient of the lubricant-coolant.

The effect of different ingredients and their relationships on the cutting capacity of the tool and quality of the machined surface was studied while selecting the optimal composition for producing a diamond tool.

Alongside high specific removals of material, provided by the tool of the cited composition, the minimal roughness of the machined surface is attained.

The diamond tool of the cited composition is produced as follows. Ingredients are thoroughly mixed and introduced into epoxy resin in the following succession: diamond dust, a mixture of salt and acid, pre-pulverized in the mortar, cerium dioxide and polyethylene polyamine (hardener). The mass is stirred to become a uniform consistency and is poured to the molds in the form of separate preforms, and is kept at room temperature for at least 14 to 16 hours. Then, the diamond-bearing elements are thermally treated at 370° to 390° K for two hours, whereupon they are slowly cooled to room temperature.

When developing the diamond tool it was necessary to take into consideration the specific of coarse and fine grinding. The operation of coarse grinding (transition I) for a given class of machined components is intended for productive removal of the layer of the original blank with the polished, as a rule, surface and obtaining the surface with a highly accurate geometrical form.

During the operation of fine grinding (transition II) the depth of the material layer broken at the transition I should be reduced to the maximum extent and the shape of the surface should be eventually formed, i.e. the surface should be prepared for polishing.

Comparative profilograms of the machined surfaces of glass blanks for masks at the transitions I and II of grinding with different tools are given in FIGS. 10 (*a–d*). FIGS. 10 (*a,b*) illustrates profilograms of the surfaces machined at cast iron laps by the suspensions of micropowders with 20 μm grain size (transition I) and 10 μm (transition II), having the surface roughness $R_a$ of 0.84 and 0.46 μm, respectively. The profilograms of the surfaces machined by the developed diamond tool, following the transitions I and II, are given in FIGS. 10 (*c,d*). The roughness of surface R for each case is 0.42 and 0.16 μm, respectively. High quality of the ground surface allows the time of subsequent polishing to be drastically reduced.

The cutting capacity of the diamond tool is enhanced under low unit loads by using phenoplast, namely thermoreactive molding mass based on phenol aldehyde resins, or aminoplast, namely thermoreactive molding mass based on carbamido-, melamino- and carbamido-melamino-formaldehyde resins, or a phenoplast/aminoplast mixture, as a binding agent in the diamond-bearing mass.

It was established that introducing an auxiliary abrasive and functional additive to the diamond-bearing mass based on epoxy resin with a hardener, and aminoplast and/or phenoplast as an additional filler, or their mixture in the amount of 2 to 40 wt. % helps enhance the efficiency of grinding by 20% on average.

Using the cited thermoreactive molding masses (aminoplast and phenoplast) in the composition to produce a diamond tool enables the novel properties of the cited materials to be revealed and successfully used, namely:

- using it as an auxiliary abrasive actively involved in forming the microrelief of the surface machined;
- using it as the basic functional additive, i.e., a filler, providing the opening of the diamond-bearing mass and operation of the diamond tool in the conditions of self-sharpening;
- using this thermoreactive fine-dispersed material enhances the wear resistance and strength of the diamond-containing composition.

The revealed properties of phenoplast and aminoplast made it possible to use these materials as the basic binding agent in producing a diamond tool. The tool, containing the cited binding agent in the amount of 95.0 to 99.7 wt. % and the diamond dust in the amount of 0.3 to 5.0% features a high cutting capacity within a broad range of unit pressures from 0.01 to 1 MPa. This property is unique. For instance, diamond tools based on a metal or ceramic binder operate under unit pressures of at least 0.1 MPa, and based on an organic binder—0.05 to 0.15 MPa.

In addition, the diamond tool with a binding agent from phenoplast and/or aminoplast is easy to produce. Molding of diamond elements—preforms is carried out at a temperature from 120° to 200° C. (390–470 K) and pressure (150–1200) 9.81×104 Pa. Altering the molding conditions, one can control within a broad limits, the properties of diamond preforms obtained.

EXAMPLES

1. Glass blanks were ground and polished to make masks $127_{-0.8}\times127_{-0.08}\times2.6_{-0.4}$ mm from thermally polished float glass, rejected in planeness and purity or cleanliness 35 of the surface. Grinding in two transitions was effected by means of a coupled diamond tool based on epoxy-dian resin and a hardener—polyethylenepolyamine.

Grinding was performed at a two-sided machining planetary type machine. There were four blanks, concurrently machined at each lap with an inside diameter of 250 mm and outside diameter of 630 mm. The grinder is made of 16 mm diameter diamond preforms for the first transition and 11 mm diameter for the second, arranged on seven concentric rows. Grinding was carried out under the following technological conditions: the spindle rotary velocity is 100 revolutions per minute, total force applied to the machined components is ≈200N (at the first transition).

Used in coarse grinding were four holders made of textolite, 16 mm in thickness with through ports $127.5_{+0.2}\times127.5_{+0.2}$ mm in size. Used as three-layer lining were two resilient elements made of polyurethane foam plastics, each 5 mm in thickness with an elasticity modulus of 300 MPa, an 8 mm thick jumper being arranged between these resilient elements. The total thickness of the lining and components (two rows of components with a three layer lining therebetween) in the loaded state is 17 mm, which provides distribution of the force of the top lap only to the machined components. The time of grinding in the first transition is 4 minutes. Roughness of the machined surface is $R_a$=0.42 μm. Grinding within the cited conditions, using the described diamond tool, provides a concave surface with a concave camber of 3 to 4 μm.

In the finish fine grinding (second transition) of mask blanks, following coarse grinding, there were used 4 holders made of sheet material, 4 mm in thickness, from both sides of which are secured 188 mm diameter disks of sheet textolite, 3 mm in thickness with recesses $127.5_{+0.2}\times127.5_{+0.2}$ mm in size. Stuck to the surfaces of the holders in the recesses are resilient elements from sheet polyurethane foam plastics, 3 mm in thickness each. The period of grinding at the second transition is 4 minutes. Roughness of the machined surface was $R_a$=0.16 μm.

Polishing was carried out under the following conditions: the spindle rotary velocity is 60 revolutions per minute, total force on 4 machined blanks was 280 H, the Polirit suspensions density (1.09–1.1) $10^3$ kg/m$^3$, pH=7. Used as a polishing cloth was industrial felt made of chemical fibers, preheated at 120° C. for one hour. The time of polishing was 20 minutes. Polirit consumption was $0.5\times10^{-3}$ kg/min. Planeness of the surface after polishing was below 0.5 μm in a 102 mm diameter working zone.

2. Glass blanks were produced for magnetic disks 65 mm in diameter. The original blanks 74 mm in diameter and $1.0_{+0.2}$ mm in thickness were ground in two transitions: at the first transition using a coupled diamond tool in the course of 2 minutes up to 0.8 mm in thickness, thereafter, in the second transition by means of a diamond tool for 4 minutes with dwelling up to 0.7 mm in thickness.

The total load/force at the second transition is 120N, with dwelling—40N. 12 components, arranged in two rows, were concurrently ground in the holders consisting of two spring-loaded parts.

Polishing was effected for 10 min up to 0.635±0.025 mm in thickness.

Upon polishing, a 74 mm diameter blank was cut to size (outside diameter—65±0.1 mm and inside diameter—20±0.038 mm) using laser radiation. The cutting was carried out as follows.

Used as a laser was a LG-25A type laser on carbon dioxide, 36 W capacity with a wavelength of 10.6 μm. Laser radiation was focused with the aid of an elliptic section. A 1.5 mm long slit was made along the cutting line (along the greater diameter of 65 mm) using a diamond pyramid. An air-water mixture fed to the heating zone under pressure of $2.5\times10^5$ Pa was used as a coolant. The cutting seed was 45 mm/s. The accuracy of cutting was 10 μm. Cutting along the 20 mm inside diameter was effected analogously.

The results of tests of above mentioned method for treatment, with details of corresponding equipment to show this method by some examples of polishing, grinding and cutting (in correspondence with sizes) under the different technological parameters, are shown in the tables.

The analysis of tests enables one to draw the following conclusions.

In order to observe the conditions of accurate formation of the machined surface, one should take into account and correlate the permissible unit loads on the components of a given relative thickness with unit pressures on the diamond layer, ensuring the operation of the tool used in the conditions of self-sharpening.

The components should be machined by accommodating them in two rows in the holder recesses, with a combination resilient-elastic lining therebetween. The resilient element fully copies the shape of a contacting surface and redistributes the force of the tool on the machined surface, providing a marked decrease of deformations in the components during machining. The force of pressing the component to the tool working surface can be regulated due to resilient properties or thickness of the resilient-elastic lining within a very broad range.

Using the above-described invention, alongside a decline in labour intensity of the process by reducing a number of operations involving diamond-abrasive grinding and finishing of the component edges helps to appreciably improve the quality of products, upgrade mechanical strength and operation reliability of products thanks to faultless edges after laser cutting.

INDUSTRIAL APPLICABILITY

The present invention can be used in the electronic industry to produce precision substrates for liquid crystal indicators and masks, magnetic and magneto-optical disks, in the watch making industry to manufacture protective glasses, in the automobile industry to produce lens for head and rear lamps and mirrors, as well as in other branches of engineering and industries where precision products from nonmetal materials are used.

TABLE 1

Results of Testing the Process for Machining Components Made of Brittle Materials

| Example No 1 | Parameters of Machining: h/D 2 | Q, MPa 3 | $E_0$, $10^3$ × MPa 4 | H, $10^{-3}$ m 5 | E, $10^{-3}$ × MPa 6 | Coefft. 0.7–7 7 | Test Results: Roughness $R_a$ μm 8 | Planeness μm 9 | Yield of finished products % 10 |
|---|---|---|---|---|---|---|---|---|---|
| 1 | 0.1 | 0.05 | 70 | 1.5 | 2 | 0.7 | 0.32 | 0.5 | 94 |
| 2 | 0.1 | 0.2 | 70 | 1.5 | 2 | 2 | 0.42 | 1.0 | 98 |
| 3 | 0.1 | 0.5 | 70 | 1.5 | 2 | 7 | 0.46 | 1.5 | 90 |
| 4 | 0.02 | 0.01 | 70 | 5 | 0.3 | 0.7 | 0.16 | 1.0 | 92 |
| 5 | 0.02 | 0.04 | 70 | 5 | 0.3 | 2 | 0.20 | 1.0 | 96 |
| 6 | 0.02 | 0.1 | 70 | 5 | 0.3 | 7 | 0.24 | 2.5 | 91 |
| 7 | 0.005 | 0.003 | 70 | 3 | 0.3 | 0.7 | 0.08 | 1.5 | 93 |
| 8 | 0.005 | 0.01 | 70 | 3 | 0.3 | 2 | 0.16 | 2.0 | 95 |
| 9 | 0.005 | 0.03 | 70 | 3 | 0.3 | 7 | 0.20 | 4.5 | 89 |

TABLE 2

Possible Variants of Compositions of a Diamond-Abrasive Tool

| Ingredients of Compositions | Compositions of ingredients, wt. % Variant No 1 | 2 | 3 | 4 | 5 | 6 | 7 | 8 |
|---|---|---|---|---|---|---|---|---|
| Epoxy resin | 56 | 40 | 70 | 56 | 56 | 56 | — | — |
| Hardener | 8 | | 9 | 8 | 8 | 8 | — | — |
| Diamond dust | 2 | 4.5 | 1.5 | 2 | 8 | 0.5 | 3 | 1 |
| Cerium dioxide | 28 | 1 | — | 10 | 22 | 28 | — | — |
| Zirconium dioxide | — | — | 15.5 | — | — | — | — | — |
| Sulfuric acid salt | 4 | 40 | 2 | 4 | — | 4 | — | — |
| Phosphoric acid salt | — | — | — | — | 4 | — | — | — |
| Oxalic acid | 3 | 8 | — | 3 | — | 4.5 | — | — |

TABLE 2-continued

Possible Variants of Compositions of a Diamond-Abrasive Tool

| | Compositions of ingredients, wt. % Variant No 1 | 2 | 3 | 4 | 5 | 6 | 7 | 8 |
|---|---|---|---|---|---|---|---|---|
| Citric acid | — | 6.5 | 2 | — | 3 | — | — | — |
| Aminoplast | — | — | — | 18 | — | — | 97 | 99 |
| Phenoplast | — | — | — | — | — | — | — | — |
| Process Parameters | | | | | | | | |
| Duration of grinding, min | 2 | 4.5 | 8 | 1.5 | 4 | 7 | 2 | 6 |
| Roughness, $R^a$, μm | 0.32 | 0.42 | 0.36 | 0.32 | 0.46 | 0.42 | 0.32 | 0.42 |
| Yield of finished products, % | 98 | 60 | 52 | 98 | 86 | 70 | 97 | 89 |

I claim:

1. A process for machining flat components made of brittle materials, in which the components are placed in holders, loaded by force, pressing the components to a tool, and the components and the tool are moved relative to each other in a plane of machining, characterized in that in order to machine surfaces of the components, the process comprises choosing a unit load for the tool on a component, subject to a relative thickness of the component, from a relationship as follows:

$$Q=(0.7-7)\times10^{-5}\times h/D\times E_0,$$

where

Q is the unit load applied by the tool on the component, Mpa;

h/D is a relative thickness of the component;

h is thickness of the component, m;

D is a length of a straight line passing between two points on edges of the component while also passing through a centerpoint of the component, m;

$E_0$ is elasticity modulus of material of the component, Mpa, providing a decline in deformations of components during machining.

2. A process as defined in claim 1 wherein the surfaces of the flat components are machined by a diamond-abrasive tool.

3. A process as defined in claim 1 further comprising, following machining of surfaces of the component, the edges of the component are additionally machined to size, wherein machining to size is effected by first making a slit along a cutting line, heating the cutting line by laser radiation with a power density $(0.2–20)10^6$ $Wm^{-2}$ and a wavelength for which an edge being cut is opaque, given a relative movement of laser radiation and the edge, local cooling of heated zones using a coolant, and removing unwanted material, whereby surfaces of the component are first machined and then machined to size.

4. A device for machining components to a desired surface form, comprising two surface plates, on one of which is secured a tool to machine surfaces of components, and on another a resilient lining is arranged on which a holder is secured with recesses to accommodate the components, a clamping mechanism, applying force via one of the surface plates on the components, and a rotary drive of at least one of the surface plates, wherein the thickness of the resilient lining is determined from a relationship as follows:

$$\frac{0.4\,Q}{\frac{h}{D}\,E} \leqq H \leqq \frac{10\,Q}{\frac{h}{D}\,E},$$

where

Q is a unit load of the tool on the component, Mpa;

h/D is a relative thickness of the component;

h is thickness of the component, m;

D is a length of a straight line passing between two points on edges of the component while also passing through a centerpoint of the component, m;

E is elasticity modulus of the lining material, Mpa;

H is thickness of the resilient lining, m, and the tool is made up of individual diamond-abrasive preforms, wherein arrangement and composition of the preforms are chosen so that as the components are machined, a preassigned form of machined surface is obtained and force applied by the tool on the components is regulated.

5. A device as defined in claim 4 wherein rigidity of the resilient lining declines from the edge towards the center.

6. A device for machining components to a desired surface form, comprising an upper and lower tool, made in the form of disks with a diamond-abrasive coating, holders being arranged between the disks and mating with gears, the holders having recesses to accommodate the components, and a drive to rotate the tool and the holder relative to one another, wherein the diamond-abrasive coating is in the form of individual preforms arranged on the disks, the arrangement and composition of the diamond-abrasive preforms being selected so that as the components are machined, a preassigned form of machined surface is provided and force applied by the tool on the components is regulated and wherein the diamond-abrasive preforms are secured on the disks in an odd quantity of concentric zones and a quantity of the preforms covered by one component is determined from a relationship as follows:

$$n_1 = \frac{(0.2-2)\,10^4\,P}{\frac{h}{D}\,S\,K},$$

and a quantity of abrasive elements in any zone and in a middle zone is determined from respective formulae:

$$n_1(0.8–1.2)n_1+n_1/4(i-1)$$

$$n_{i0}=(1.02–1.2)[(0.8–1.2)n_1+n_1/4(i_0-1)],$$

where $n_1$ is the quantity of abrasive elements covered by one component;

P is total force, N;

h/D is relative thickness of the component, i.e. relation between thickness and length of a straight line passing between two points on edges of the component while also passing through a centerpoint of the component;

S is area of working surface of one abrasive element, $m^2$;

K is quantity of concurrently machined components by each lap;

$n_i$ is quantity of abrasive elements in an i-th zone;

$n_{i0}$ is quantity of abrasive elements in the middle zone;

$i_0$ is an ordinal number of the middle zone.

7. A device as defined in claim 6 wherein given a unilateral machining of components, the components are placed in two rows in a holder, and a resilient lining is arranged between the rows, each lining made composite of, at least, two separate resilient elements connected to each other by means of a jumper, providing uniform application of force on flat surfaces of the components during machining.

8. A device as defined in claim 7 wherein the resilient elements and/or jumper are made discrete.

9. A device as defined in claim 8 wherein the resilient elements are made in a form of tanks filled with gas or liquid.

10. A device as defined in claim 7 wherein the holder is used as the jumper of the lining, with resilient elements being arranged directly on a surface of the holder.

11. A device as defined in claim 6 wherein the holder is made as a slit in a plane of machining, and between the holders are accommodated spring-loaded supports and the holders are connected to each other by guides, providing movement of the holders in a plane perpendicular to that of machining, rigidity of the spring-loaded supports and the resilient elements of the linings being found from a relationship as follows:

$$0.1\,C_2<C_1<C_2$$

where $C_1$ is rigidity of the spring-loaded supports;

$C_2$ is rigidity of the resilient elements of the linings.

12. A device as defined in claim 4 wherein abrasive elements are arranged in a matrix, secured on a base of the tool and whose wear resistance is lower than that of the abrasive elements.

13. A device as defined in claim 12 wherein the matrix for grinding or polishing abrasive elements is made of industrial felt of chemical fibers, preheated at a temperature from 90° to 140° C. for 0.5 to 5 hours.

14. A device as defined in claim 4 wherein the diamond-abrasive preforms contain ingredients with a ratio in wt. % as follows:

| | |
|---|---|
| binding agent | 44.5–79, |
| diamond dust | 0.04–8.0, |
| auxiliary abrasive | 10–40, |
| functional additive | 2.2–22.0. |

15. A device as defined in claim 14 wherein epoxy resin with a hardener, in wt. %, is used as a binding agent:

| | |
|---|---|
| epoxy resin | 40–70 and |
| hardener | 4.5–9.0. |

and cerium or zirconium dioxide is used as an auxiliary abrasive, and a mixture of water-soluble salt of sulfuric or phosphoric acid (40 to 70 wt. %) and oxalic or citric acid (30 to 60 wt. %) is used as a functional additive.

16. A device as defined in claim 4 wherein phenoplasts, i.e. thermoreactive molding masses based on phenol aldehyde resins, or aminoplasts, i.e. thermoreactive molding masses based on carbamido-, melamino-, and carbamido-melamino formaldehyde resins, or a mixture of phenoplasts and aminoplasts, are used as a binding agent to produce the diamond-abrasive preforms.

* * * * *